United States Patent [19]

McDaniel et al.

[11] Patent Number: 4,582,099

[45] Date of Patent: Apr. 15, 1986

[54] WASTE SLURRY LIQUID REMOVAL SYSTEM

[75] Inventors: Keith K. McDaniel, Laurel; Edgar M. Cloeren, III, Columbia, both of Md.; Charles T. Nentwig, Thornton, Pa.; Stephen G. Pearre, Glen Burnie, Md.

[73] Assignee: Westinghouse Electric Corp., Pittsburgh, Pa.

[21] Appl. No.: 564,052

[22] Filed: Dec. 21, 1983

[51] Int. Cl.[4] ..... B65B 3/04

[52] U.S. Cl. ..... 141/65; 210/416.1; 252/631

[58] Field of Search ..... 252/626, 631, 633; 210/416.1; 141/1-12, 65, 66, 285-310

[56] References Cited

U.S. PATENT DOCUMENTS 4,422,964 12/1983 Capolupo ..... 252/631

*Primary Examiner*—Houston S. Bell, Jr.

*Attorney, Agent, or Firm*—Joel R. Petrow

[57] ABSTRACT

Described is an apparatus for removal of liquid from a waste burial container holding a slurry of waste material. Constructed inside the container are multiple layers of porous plastic pipe having pores of predetermined size and having the pipe extend radially from a central hub. The porous plastic pipe is supported internally by a sleeve in contact with the pipe inner wall at the pipe's hub end and a rod of smaller diameter running the length of the pipe. The hubs rest on plates that are affixed to vertical supports. Each hub is connected to a liquid removal system that includes piping and a header for applying a vacuum to draw the liquid from the slurry.

7 Claims, 4 Drawing Figures

WASTE SLURRY LIQUID REMOVAL SYSTEM

BACKGROUND OF THE INVENTION

Current regulations for the burial of low level radioactive solid wastes require that the drainable liquid of a solid/liquid slurry in a burial container be less than 0.5% of the waste volume for a steel liner and less than 1% for a high integrity container. Regulations concerning high integrity containers further require that any apparatus internal to the burial container not cause the container to rupture during specified accident conditions.

Because any drain system in a burial container with a nuclear waste slurry would become contaminated during use, the preferred system would remain in the container for burial with the waste. This expendability dictates that the drain system itself occupy a relatively small volume and be inexpensive.

One current liquid removal system for steel liners utilizes precoated epoxy-sand filters that rest on the bottom of a waste burial container and draw liquid from the waste slurry through the epoxy-sand filter and out a conduit. The weight of this filter type demands that the filter underdrain be located on the floor of the container. The heavy support system needed for systems of this type are impractical in high integrity containers due to danger of container perforation during an accident.

The rate at which liquid is removed decreases as solids build up on the epoxy-sand filter underdrain. Due to the precoat, backflushing is impractical in that the precoat is destroyed during the backflush operation.

Desired is a separation system that, in addition to meeting the above regulations, is well distributed throughout the waste burial container for more homogeneous removal of liquid, and capable of being backflushed whenever solid accumulation on the filter elements restricts liquid flow.

SUMMARY OF THE INVENTION

To rapidly remove the liquid from a waste slurry within a waste burial container, an apparatus is provided inside the burial container having plastic filtration tubes extending radially from centrally located liquid withdrawal pipes and having pores of a predetermined, controlled size. The filtration tubes are arrayed in a multilayered configuration to provide liquid removal capability at elevations in addition to the bottom. The filtration tubes are closed at one end and supported internally by sleeves at the open end that are connected to the withdrawal pipes. Further support is provided by an internal rod that runs substantially the length of the filtration tube. Neither the tubes nor the rods pose a puncture hazard to the container during postulated accident conditions. A combination fill head and suction head located at the opening of the container provide a system for adding waste slurry material while applying suction to one or more of the drainage layers to remove the liquid filtered from the slurry.

BRIEF DESCRIPTION OF THE DRAWINGS

For a better understanding of the invention reference may be made to the preferred embodiment. Exemplary of the invention shown in the accompanying drawings is.

DESCRIPTION OF THE PREFERRED EMBODIMENT

Figure 1:
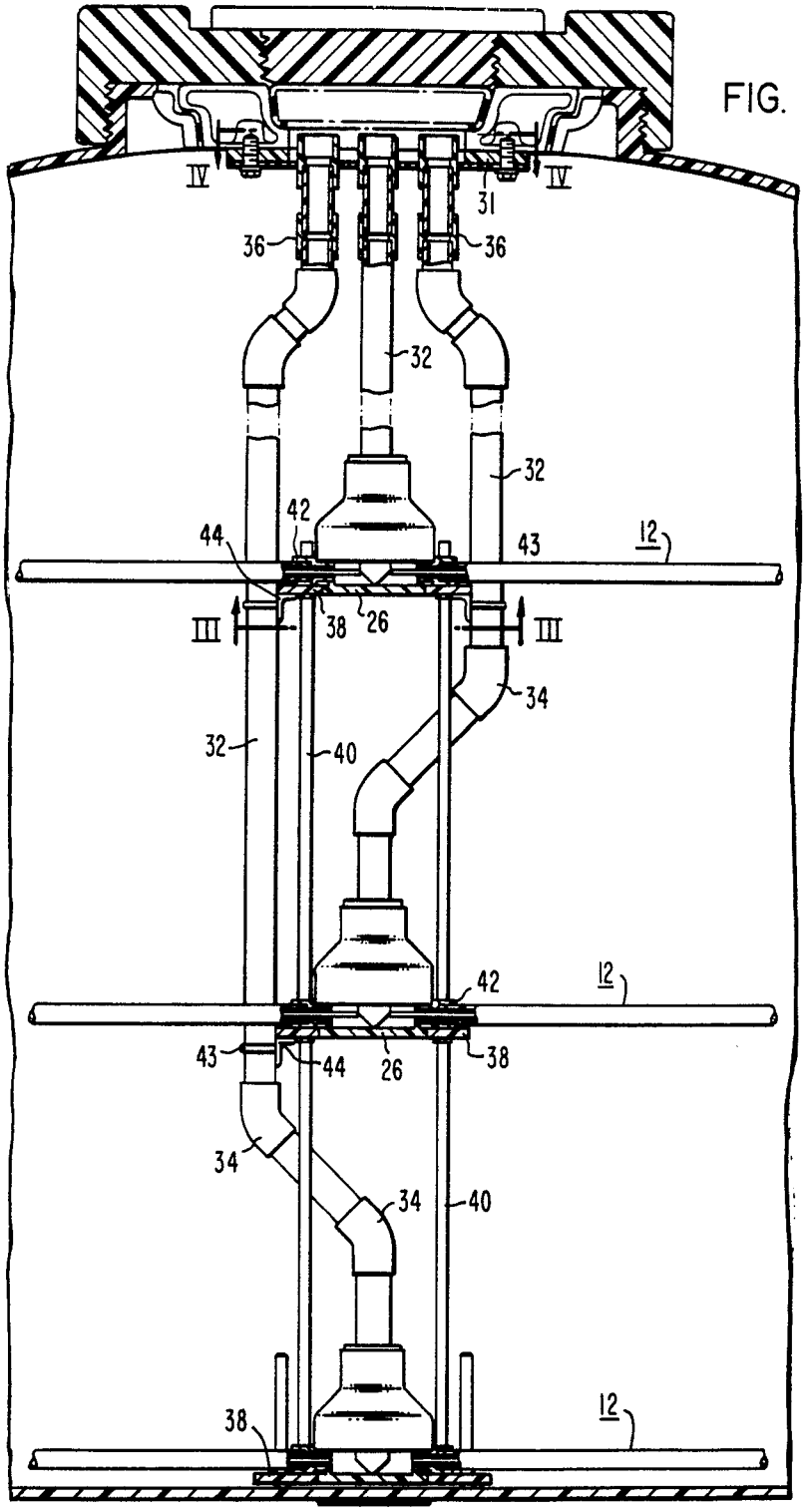
FIG. 1 which is an elevational view showing in section the construction of the waste filtration system in a high integrity container.
Figure 2:
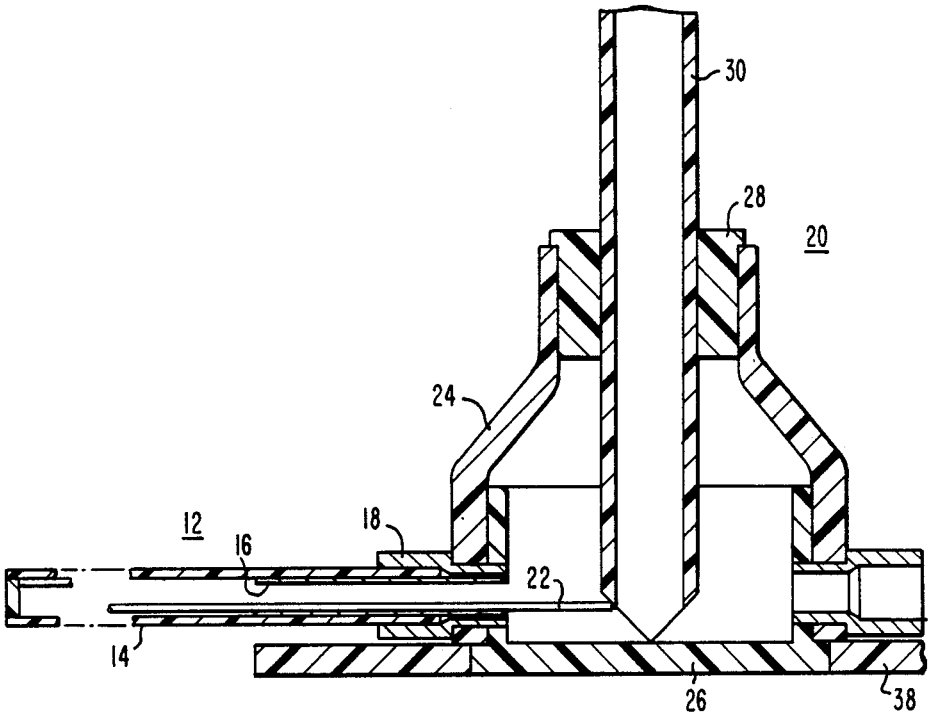
FIG. 2 which is a sectional view of one of the filtration elements showing the porous plastic pipe, the inner sleeve, the support rod, and the coupling.

As shown in FIG. 1, the preferred embodiment is a three tier drain system with filter elements 12, supporting structure, and suction piping which gives additional rigidity to the support structure. As shown in FIG. 2, a porous pipe filtration means such as filter element 12 comprises a porous plastic pipe 14 with a rigid inner sleeve such as a short piece of steel tubing 16 inserted at its support end to act as pipe support means giving additional strength in the critical load section of the pipe during shipping and process loading. The porous plastic pipe is made, for instance, of polypropylene with an average pore size of 30 microns. A coupling means such as copper fitting 18 is bonded to the same end with an epoxy. The threaded copper fitting 18 enables the pipe to be screwed into mating threads in the hub assembly 20 such that the hub assembly acts as a pipe locating means. A rigid inner rod 22 is inserted the full length of the porous pipe to act as further pipe support means. The pipe support means limits bending of the porous pipe so it can withstand shipping loads of twice the acceleration of gravity and process loading.

Figure 3:
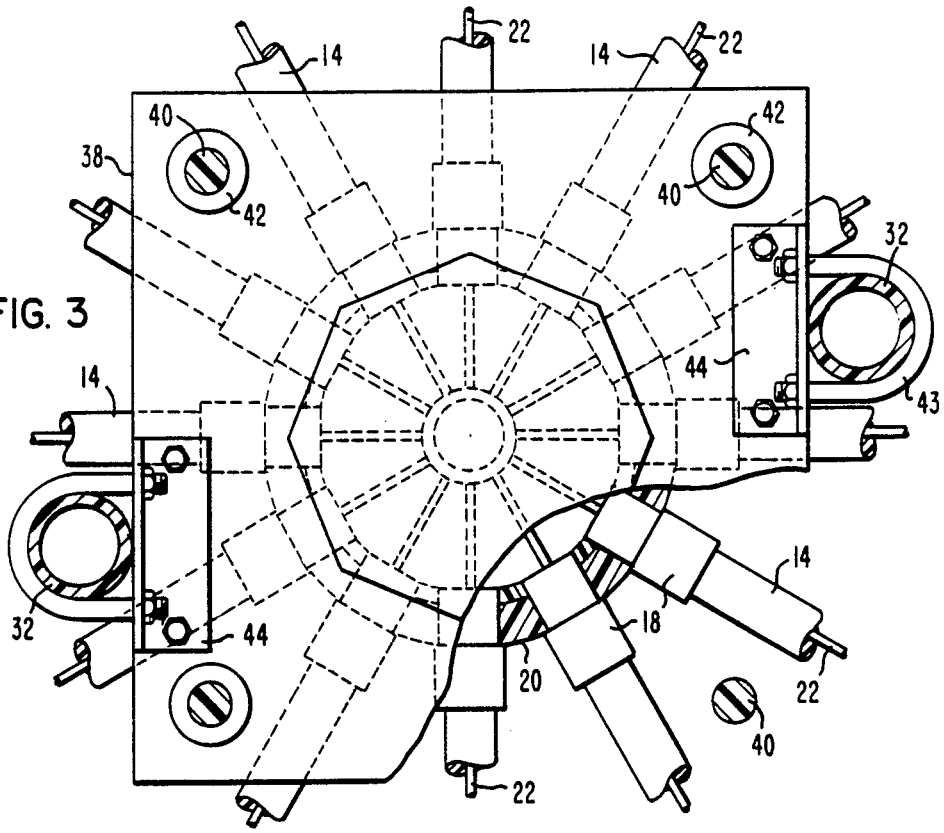
FIG. 3 which is a sectional view of a typical layer of filtration elements.

As shown in FIG. 3, twelve filter elements are arranged in a radial planar array by attachment to pipe locating means such as the hub assembly. Each of the three hub assemblies forms such an array when fitted with filter elements; the arrays are substantially parallel to the container bottom. The inner rods 22 are not used in the bottom layer because the container bottom provides the required support to the filter elements 12.

It is shown in FIG. 2 that each hub assembly 20 forms as part of the liquid removal means a suction header into which the twelve filter elements 12 feed. The hub consists of a polyvinyl chloride (pvc) concentric reducer 24, pvc pipe plug 26 which closes the larger end of the reducer, pvc bushing 28 that forms a seal between the reducer 24 and a piece of pvc beveled pipe 30. The pipe is beveled so as to draw suction from the hub compartment bottom without leaving a gap where free standing water may accumulate.

As shown in FIG. 1, each hub assembly is piped individually to a connecting means such as combination fill and suction head 31 for applying a source of suction at the top of the container using pvc pipes 32 to span the vertical distances. Elbows 34 axially offset the piping of one hub from the hub above it, and couplings 36 connect the pipes 32 to the fill plate 31. The pipes 32, elbows 34, and couplings 36 form the remainder of the liquid removal means. Each hub 20 is additionally supported by a three level support stand consisting of pvc plates 38, one plate under each hub assembly 20 which are vertically affixed to pvc round bar 40 with pvc fittings 42. U bolts 43 retain the pipes 32 to the pvc plates 38 through bracket 44 attached to plate 38.

The fill plate 31 at the top of the plastic container is attached to the bottom of the annular manway plug by bolts 46 in the plug. The bolts 46 give a means of attachment to the annular plug yet maintain the integrity of the container providing no leak paths through the attachment points.

The entire three level underdrain assembly may be assembled through the manway opening in the waste disposal container after the container is fabricated. The entire assembly will collapse upon impact without rupturing the container.

Figure 4:
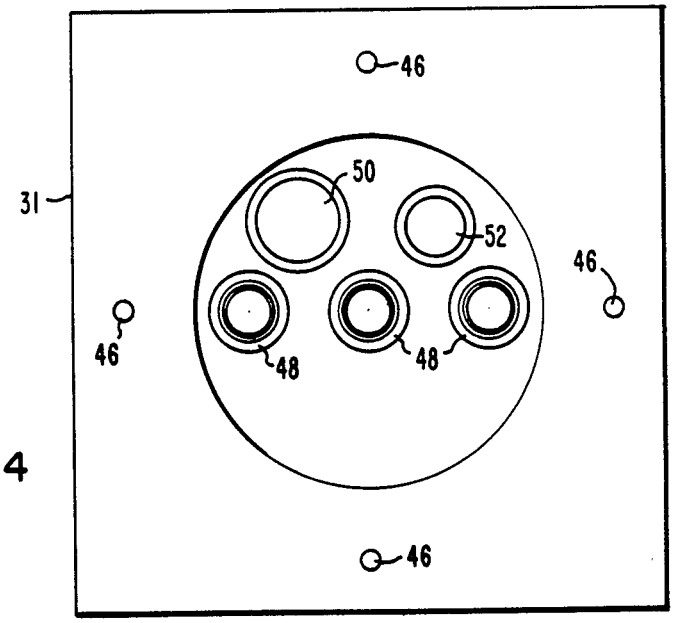
FIG. 4 which is a top view of the opening of the waste disposal burial container showing the fill plate through which the waste slurry is added and from which the liquid is removed from the slurry.

In FIG. 4, the fill plate 31 consists of three suction connections 48, one fill connection 50, and either a vent connection or an inspection port 52.

In operation, a vacuum is applied to each suction line 48 as its associated layer of filter elements is covered. The slurry is fed through the fill connection 50 in the fill plate 31 which is equipped with a diffuser plate which distributes the slurry throughout the container. Filling and dewatering are done simultaneously. When vacuum is lost in a layer the valve which connects that layer to the vacuum source is shut until the level in the container rises. When the container reaches capacity, filling is discontinued until the suction lines draw more fluid from the container. Should the filter elements become caked with solids inhibiting the flow of liquid, that level of elements may be backflushed by reversing the liquid flow.

The fill head design provides for external disconnection after dewatering is completed without the need of cutting hoses or electrical cable. Extension pipes may be used in the fill, suction, and vent lines to allow removal of liquid further away from the contamination source. The completely enclosed fill plate except in the case of an inspection port also helps in reducing direct exposure to contamination.

We claim:

1. An apparatus for the removal of liquid from a container that holds a slurry, said apparatus comprising:

porous pipe filtration means having pores of predetermined size that allow passage of the liquid while preventing passage of substantially all of the solid portion of the slurry, pipe locating means for the positioning of said porous pipe filtration means at predetermined locations inside the container, pipe support means limiting the movement of said porous pipe filtration means relative to said pipe locating means such that said porous pipe filtration means do not bend to fracture, liquid removal means connected to said porous pipe filtration means such that the liquid separated from the slurry by said porous pipe filtration means can be discharged from the container, and connecting means for applying a source of suction to said liquid removal means, drawing liquid from the slurry via said liquid removal means.

2. The apparatus of claim 1 wherein said pipe support means comprises:

a rigid inner sleeve in contact with the interior of said porous pipe filtration means proximate the open end of the porous pipe filtration means and affixed to said pipe locating means.

3. The apparatus of claim 1 wherein said pipe support means comprises:

a rigid inner rod extending substantially the length of selected said porous pipe filtration means and affixed to the pipe locating means.

4. The apparatus of claim 1 wherein said pipe support means comprises:

a rigid inner rod extending substantially the length of all of said porous pipe filtration means and affixed to the pipe locating means.

5. The apparatus of claim 1 in which said porous pipe filtration means are located in radial planar arrays substantially parallel to the plane of the container bottom.

6. The apparatus of claim 1 wherein one end of a coupling means is bonded to said porous pipe filtration means and the other end has a threaded portion matching mating threads on said pipe locating means.

7. The apparatus of claim 5 wherein each of said planar arrays of porous pipe filtration means is connected to liquid removal means functionally isolated and independent of the remaining liquid removal means which are connected to their respective planar arrays of porous pipe filtration means.

* * * * *